US009539605B2

(12) United States Patent
L'Heureux et al.

(10) Patent No.: US 9,539,605 B2
(45) Date of Patent: Jan. 10, 2017

(54) GRAVURE ROLL EDGE MASKING SYSTEM FOR IN-LINE FILM COATING

(75) Inventors: Jeffrey S. L'Heureux, North Kingstown, RI (US); Joshua R. Cloutier, Exeter, RI (US); Will E. Nunn, Carolina, RI (US)

(73) Assignee: TORAY PLASTICS (AMERICA), INC., N. Kingstown, RI (US)

( * ) Notice: Subject to any disclaimer, the term of this patent is extended or adjusted under 35 U.S.C. 154(b) by 416 days.

(21) Appl. No.: 13/407,365

(22) Filed: Feb. 28, 2012

(65) Prior Publication Data

US 2013/0224383 A1 Aug. 29, 2013

(51) Int. Cl.

| | |
|---|---|
| ***B05C 1/08*** | (2006.01) |
| ***B41F 9/10*** | (2006.01) |
| ***D06B 1/14*** | (2006.01) |
| ***B05B 15/04*** | (2006.01) |

(52) U.S. Cl.

CPC ..... *B05C 1/0839* (2013.01); *B05B 15/045* (2013.01); *B05C 1/08* (2013.01); *B05C 1/0813* (2013.01); *B05C 1/0826* (2013.01); *B41F 9/10* (2013.01); *D06B 1/143* (2013.01)

(58) Field of Classification Search

CPC ..... B05C 1/083; B05C 1/08; B05C 1/0821; B05C 1/0826; B05C 1/0856; B05C 21/005; C23C 14/562; C23C 14/042; C23C 16/545; B05D 1/28; B05D 2252/02; B05D 3/10; B05B 15/045; B41F 31/002; B41F 31/15; B41F 9/065; B41F 1/00; B41F 5/00; B41F 35/00; B41N 99/00; H01J 2209/015; Y10S 101/43; Y10S 101/47

USPC ..... 118/200, 261, 244, 255, 504, 693, 212; 427/282, 113, 146, 148, 207.1, 208.2, 427/249.17, 249.18, 255.31, 256, 288; 438/62, 438/944, 942

See application file for complete search history.

(56) References Cited

U.S. PATENT DOCUMENTS

| | | | | |
|---|---|---|---|---|
| 2,631,384 | A * | 3/1953 | Offen | 34/240 |
| 3,405,855 | A * | 10/1968 | Daly et al. | 242/615.4 |
| 3,552,850 | A * | 1/1971 | Royka et al. | 399/346 |
| 3,759,220 | A * | 9/1973 | Saito et al. | 118/261 |
| 3,844,813 | A * | 10/1974 | Leonard | D06B 1/143 118/118 |

(Continued)

OTHER PUBLICATIONS

"Overview of material for stainless steel" www.matweb.com Mar. 17, 2015 4 pages.*

(Continued)

*Primary Examiner* — Karl Kurple

(74) *Attorney, Agent, or Firm* — Morrison & Foerster LLP

(57) ABSTRACT

Methods and apparatuses for masking the edges of a substrate when performing direct or reverse gravure coating using a kiss-coat configuration, particularly useful for in-line coating of biaxially oriented polymeric films. The methods and apparatuses include a masking plate configured to prevent the edge of a portion of a substrate from contacting a gravure roll, the masking plate includes a top portion having a Rockwell B hardness equal to or greater than 80, and a thickness of between 0.03125 inches and 0.375 inches. This masking plate prevents build-up of coating on the edges of the substrate which otherwise can cause film orientation production instabilities such as film breaks, sticking to tenter clips, and/or edge trim recycling incompatibilities. The masking plate provides a masking method that is effective and durable, minimizing production downtime and maintenance.

9 Claims, 7 Drawing Sheets

Edge Masking Side View

(56) References Cited

U.S. PATENT DOCUMENTS

| | | | | |
|---|---|---|---|---|
| 4,116,162 | A * | 9/1978 | Dinter et al. | 118/104 |
| 4,259,380 | A * | 3/1981 | Juraschek | 427/365 |
| 4,278,345 | A * | 7/1981 | Davis et al. | 399/348 |
| 4,549,933 | A * | 10/1985 | Judd et al. | 162/281 |
| 5,302,203 | A * | 4/1994 | Zimmer | 118/117 |
| 5,370,735 | A * | 12/1994 | Beisswanger | 118/249 |
| 5,569,326 | A * | 10/1996 | Ruhl | 118/205 |
| 5,595,792 | A * | 1/1997 | Kashiwaya et al. | 427/570 |
| 5,633,045 | A * | 5/1997 | Smith et al. | 427/428.17 |
| 5,709,747 | A * | 1/1998 | Goldwasser | 118/211 |
| 5,753,076 | A * | 5/1998 | Costello et al. | 162/111 |
| 5,885,656 | A * | 3/1999 | Goldwasser | A61F 13/00991 118/213 |
| 6,104,906 | A * | 8/2000 | Horikoshi | 399/326 |
| 6,183,847 | B1 * | 2/2001 | Goldwasser | 428/219 |
| 6,197,113 | B1 * | 3/2001 | Zimmer | 118/249 |
| 6,991,757 | B2 * | 1/2006 | Rata et al. | 264/136 |
| 7,323,056 | B2 * | 1/2008 | Horie et al. | 118/227 |
| 7,632,560 | B2 * | 12/2009 | Filippini Fantoni et al. | 428/141 |
| 7,849,813 | B2 * | 12/2010 | Fett et al. | 118/244 |
| 7,891,313 | B2 * | 2/2011 | Wakai et al. | 118/204 |
| 8,020,510 | B2 * | 9/2011 | Emoto et al. | 118/410 |
| 8,132,527 | B2 * | 3/2012 | Imamura et al. | 118/413 |
| 8,418,646 | B2 * | 4/2013 | Fett et al. | 118/244 |
| 8,662,008 | B2 * | 3/2014 | Abas et al. | 118/321 |
| 8,667,927 | B2 * | 3/2014 | Dupertuis et al. | 118/413 |
| 2002/0174966 | A1 * | 11/2002 | Brauns et al. | 162/280 |
| 2003/0010284 | A1 * | 1/2003 | Nishikawa et al. | 118/258 |
| 2005/0223974 | A1 * | 10/2005 | Horie et al. | 118/227 |
| 2007/0017392 | A1 * | 1/2007 | Filippini Fantoni et al. | 101/157 |
| 2009/0084311 | A1 * | 4/2009 | Yoshida et al. | 118/46 |
| 2012/0285341 | A1 * | 11/2012 | Dedman | 101/350.1 |
| 2016/0250658 | A1 * | 9/2016 | Miura | B41F 9/10 |

OTHER PUBLICATIONS

"PTFE Coatings" www.metcoat.com Mar. 18, 2015 1-2 pages.*
"Comparison between Shore and Hardness Ranges" www.plasco-corp.com Mar. 18, 2015 2 pages.*

* cited by examiner

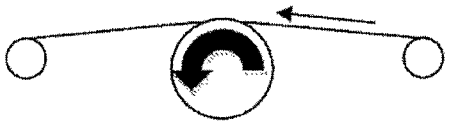
FIG. 1: Direct Kiss Coating
PRIOR ART
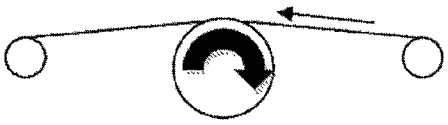
FIG. 2: Reverse Kiss Coating
PRIOR ART

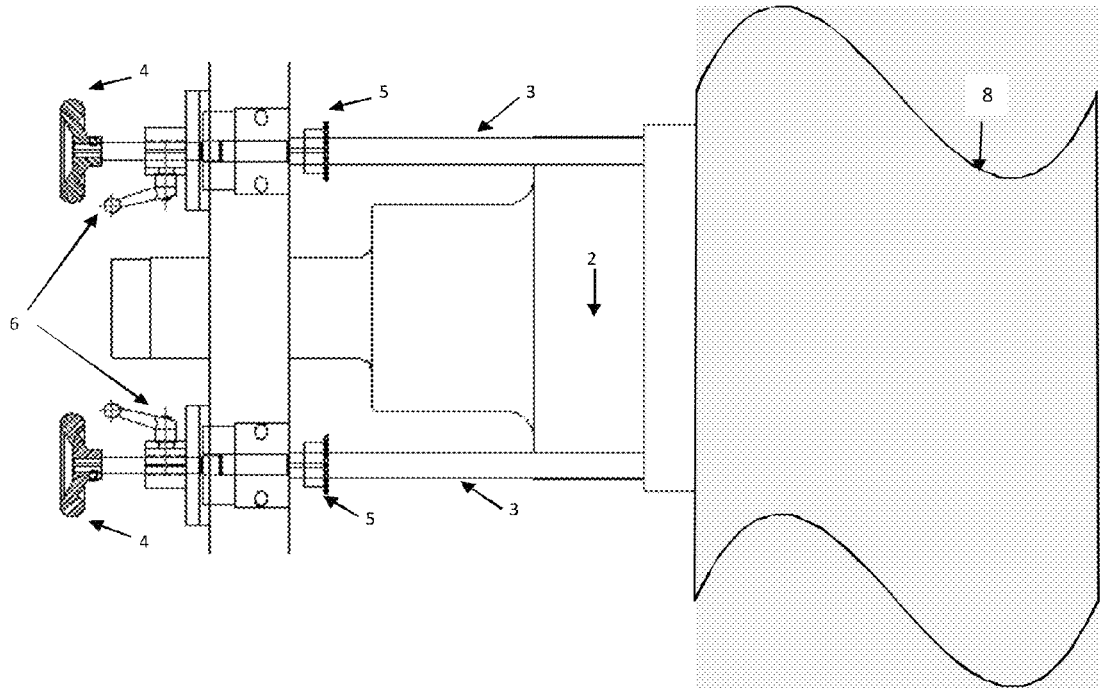
FIG. 3: Edge Masking Top View

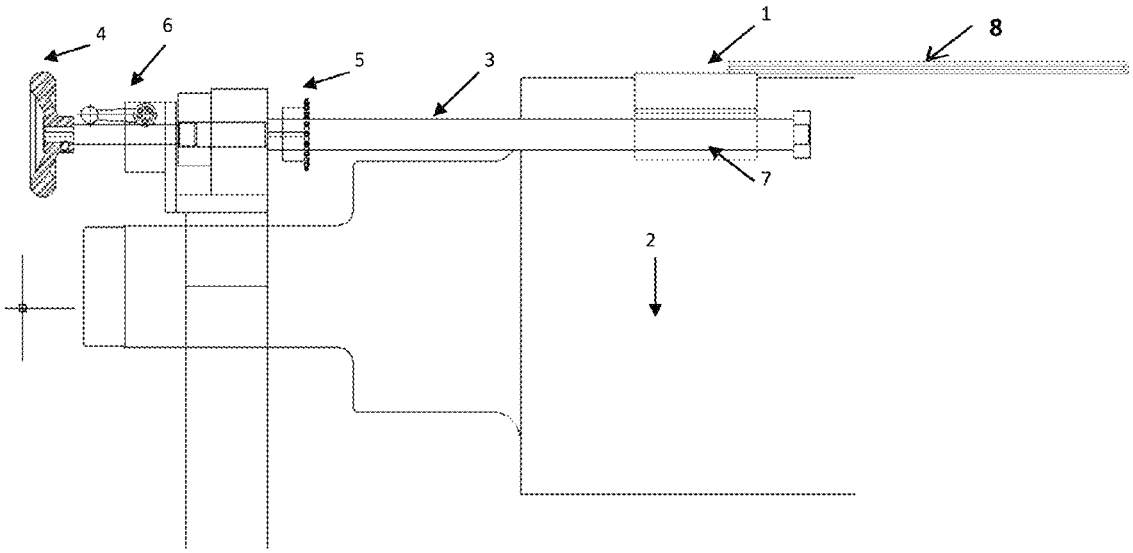
FIG. 4: Edge Masking Side View

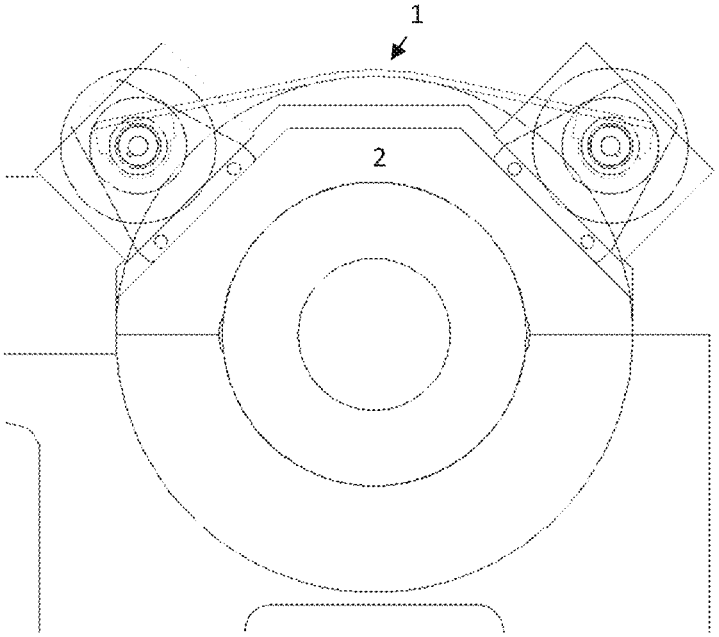
FIG. 5: Edge Masking End View

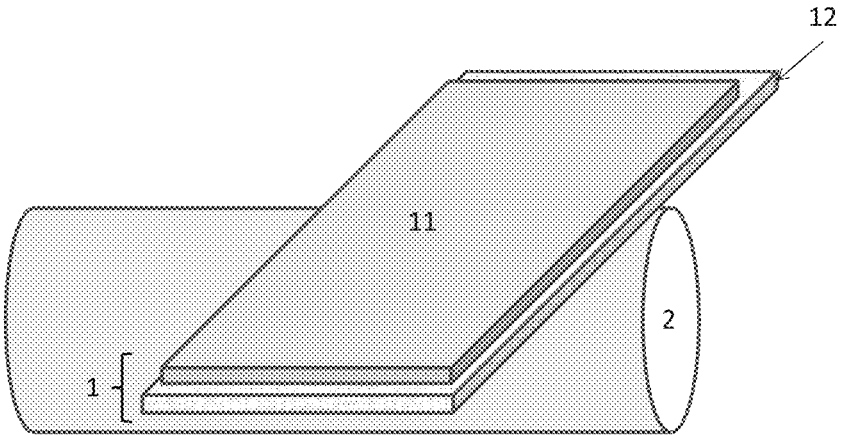
FIG. 6: Edge Masking Plate (1)

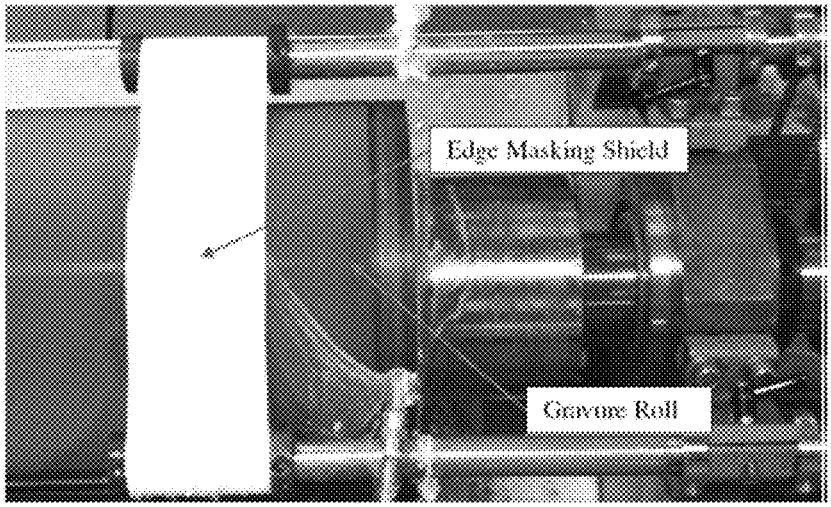
FIG. 7A: Comparative Example 1 Using Teflon® Masking Film Prior to Production Test
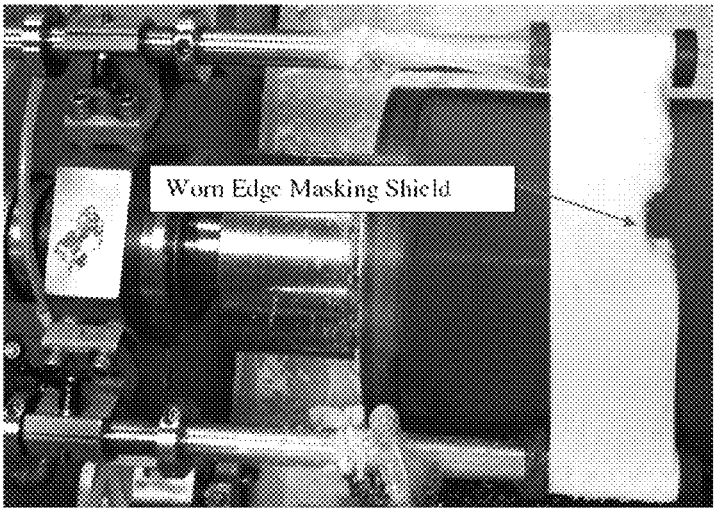
FIG. 7B: Comparative Example 1 Using Teflon® Masking Film After Production Test

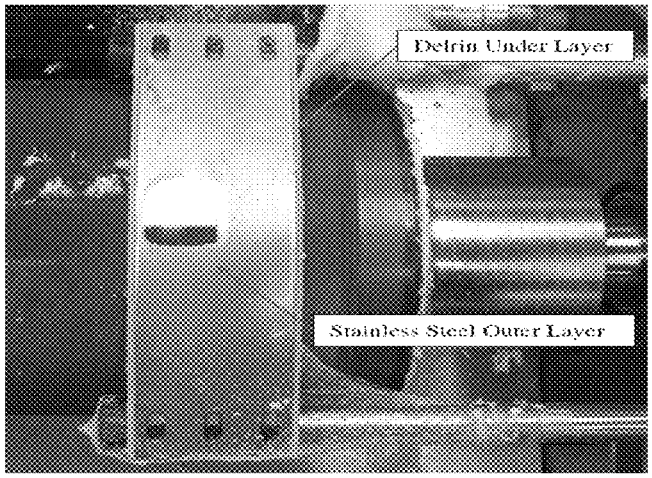
FIG. 8: Example 1 Using Dual Layer Masking Shield of Stainless Steel Plate with Delrin® Under-Layer After Production Test Exhibiting Very Little Wear
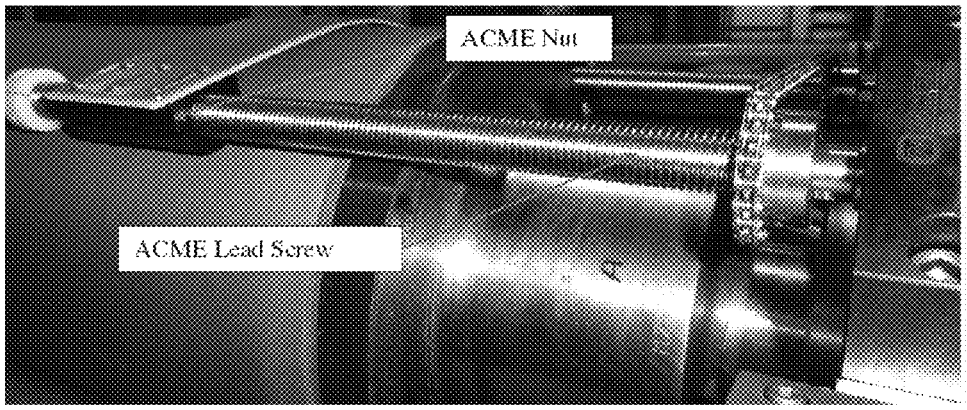
FIG. 9: Example 1 Illustrating ACME Nut and Lead Screws for Transverse Position Adjustments

GRAVURE ROLL EDGE MASKING SYSTEM FOR IN-LINE FILM COATING

FIELD OF THE INVENTION

The present invention relates to gravure coating processes in which a substrate is run in a kiss-coating configuration. In particular, the invention relates to in-line coating of biaxially oriented films wherein the coating is applied using a gravure roll process, stationed prior to the tentering oven used for transverse orientation.

BACKGROUND OF THE INVENTION

Gravure coating processes have been established and are well known within the industry, as they provide a method to coat a flexible substrate in a uniform manner. Complete coating of the substrate is common among many of these applications, particularly in printing and priming industries. However, complete coating is not advantageous in some other processes, particularly when the material is subjected to further stretching.

Biaxial orientation, which involves sequential or simultaneous machine and transverse direction stretching is common in the production of some polymer substrates (polyethylene terephthalate, polypropylene, polylactic acid, etc.) as the orientation imparts desired properties that are useful for packaging films and many industrial films. Transverse stretching is commonly done by a tenter process within the industry, wherein the edges of the film are captured by clips on a moving chain that will then stretch the film to a desired width before releasing it. In some cases, it is desirable to coat one or both sides of the substrate to provide useful properties such as gas barrier, printability, heat sealability, etc. It can be also desirable in some cases to apply the coating "in-line" in a biaxial orientation process, typically between the machine direction orientation process (MDO) and the transverse orientation process (TDO) in a sequential orientation line. (In a simultaneous orientation line, such a coating process can be placed after the extrusion and casting section but prior to the tentering oven.) Typically, a coating station is placed between the MDO and TDO and the coating may be applied by any means well-known in the art, including but not limited to gravure coating, rod coating, slot die coating, etc. Preferred is gravure roll coating. In order to avoid build-up of coating and a detrimental effect to machine performance, coating close to the thick edges of the MD-oriented sheet is avoided.

There are many configurations for gravure coating a substrate, but most can be described within two application categories: standard configurations where a backing roll places the substrate in contact with the gravure roll or offset roll; or kiss-coat configurations (see FIGS. 1 and 2) where the substrate is wrapped around the gravure roll or offset roll without the use of a backing roll. U.S. Pat. No. 3,844,813 to Leonard et al. describes these gravure coating processes onto a textile substrate. The '813 patent, however, does not disclose any edge masking systems that may be employed in the process.

Edge masking can be employed by current commercial systems provided by machinery manufacturers such as Davis Standard, LLC of Pawcatuck, Conn. Commercial designs for a conventional gravure method include manufacturing the backing roll in a way to provide a two-stepped roll diameter so that the edges of the substrate are not pressed into the gravure roll, and therefore not coated, due to a smaller roll diameter on the edges. One obvious drawback in this design is that the uncoated region can only be adjusted by changing the backing roll, necessitating significant downtime for every width change in the substrate. Additionally, in certain applications, using a backing roll can be very difficult as slight misalignments or speed differences can cause wrinkles or other defects into the finished product. Defects can also occur when running in reverse gravure (when the gravure roll runs counter to the film direction), and slight coating fluid property differences fail to provide the necessary lubricity. These defects can be particularly detrimental in further stretching processes and can cause complete failure within the process (i.e. film breaks).

Commercial designs for kiss-coat edge masking include use of a thin (40 mil or 1000 μm) TEFLON® (PTFE or polytetrafluoroethylene) sheet at custom widths (typically 2-4 inches or 5-10 cm) that is wound on spools before and after the gravure roll. The wound material can be manually indexed to account for wear. While this system does mask the edges it fails to provide long-term abrasion resistance with indexing potentially necessary every 30-60 minutes depending on the substrate. The indexing is also limited by the total amount of material that can be wound, necessitating a more involved change every 1-2 days with substantial downtimes incurred. Additionally, this design is in a fixed transverse location so that any product width changes require a reconfiguration of the hardware with additional downtime incurred. This lack of transverse or side-to-side adjustment flexibility while in production mode is very limiting and unproductive.

Wear to the masking material with the commercial design can be exacerbated when using gravure coating substrates with thick edges, particularly with in-line coating methods used in biaxial orientation film manufacturing. As described earlier, in many polymer orientation processes the substrate is captured within a clip system for transverse or simultaneous machine and transverse stretching. To withstand this clip system, finished thin films (less than 5 mil or 125 μm) require that the edges of the film be much thicker than the middle of the film substrate. This thick edge portion is typically about 40-50 mm wide and is the portion of the film that goes inside the tenter chain clip. The tenter chain clip then closes upon this edge portion and is the method by which the film is conveyed into the tentering oven. This edge thickness can cause excessive wear on the commercial edge masking, necessitating very frequent indexing of the masking material and eventual production losses as downtime is needed to replenish the masking material and/or clean-up of coating build-up.

Additionally, with transverse stretching of polymers, the transition between uncoated substrate and coated substrate can be exceptionally difficult to manage for stability of the process. If the desired coating thickness is high (high stretch ratio, low solids, etc), the temperature difference between the coated and uncoated polymer within the tenter oven, which performs a dual function of both drying the wet coating as well as heating the substrate to enable orientation, can lead to overstretching failure of the uncoated portion within the process. Precise management of this transition from coated to uncoated regions is desired for a stable process in this instance. With polymer stretching, slight differences in width between and during runs are common after machine direction stretching, up to 3% of the width of the MD-oriented film. This makes any fixed masking setup difficult to manage for a stable process. Thus, the masking system should have the ability to be adjusted side-to-side (or transversely) to effectively mask the edges and prevent coating of the edges if such width variations occur.

The current invention addresses the above deficiencies regarding wear and coating width management.

SUMMARY OF THE INVENTION

Described are methods of apparatus for masking the edges of a substrate when performing direct or reverse gravure coating using a kiss-coat configuration, particularly useful for in-line coating of biaxially oriented polymeric films. This masking prevents build-up of coating on the edges of the substrate which otherwise can cause film orientation production instabilities such as film breaks, sticking to tenter clips, and/or edge trim recycling incompatibilities. The invention provides a method that is effective and durable, minimizing production downtime and maintenance.

One embodiment is an apparatus to prohibit coating transfer to a substrate's edges using a gravure process. The apparatus may be used in a "kiss-coating" or wrap angle coating process where the wrap angle on the gravure roll is between 1 and 30 degrees. The apparatus may include a masking plate with a top portion having a Rockwell B hardness equal to or greater than 80 and thickness between 0.03125 inches (0.794 mm) and 0.375 inches (9.525 mm) which prevents the edge of the substrate from contacting the gravure cylinder. The gravure process can be either "direct" or "reverse" configuration. The underside of the top portion may be coated or contiguously attached to a polymeric material that is between 0.01 and 0.375 inches (0.254 and 9.525 mm) thick and has a coefficient of friction (COF) of less than 0.40.

A polymer plate may be placed directly between the masking plate and the gravure roll. The polymer plate may be between 0.03125 inches (0.794 mm) and 0.375 inches (9.525 mm) thick and have a COF of less than 0.40. The polymer plate dimensions preferably extend beyond the masking plate dimensions between 0.001 and 3.0 inches (0.0254 and 76.2 mm). The masking plate may be adjustable along the gravure cylinder face length (transversely), and controlled within 0.5 mm.

An embodiment of a masking system to prohibit coating transfer to substrate edges during a gravure coating process may include a masking plate configured to prevent the edge of a portion of a substrate from contacting a gravure roll, the masking plate including a top portion having a Rockwell B hardness equal to or greater than 80, and a thickness of between 0.03125 inches and 0.375 inches. The top portion may be metal, for example stainless steel.

The masking plate may further include a polymeric material coated or contiguously attached to the top portion, the polymeric material having a thickness of between 0.01 and 0.375 inches and a coefficient of friction (COF) of less than 0.40.

The masking plate may further include a polymeric plate configured to be placed between the top portion and the gravure roll. The polymeric plate may have a thickness of between 0.03125 inches and 0.375 inches and a coefficient of friction (COF) of less than 0.40. Preferably, the polymer plate has dimensions that extend beyond dimensions of the top portion dimensions between 0.001 and 3.0 inches. The polymer plate may be formed from a material that is less hard than the top plate.

Preferably, the masking plate is adjustable along a transverse direction of a face of the gravure roll within 0.5 mm and is shaped to a curvature of the gravure roll.

An embodiment of an in-line kiss-coating gravure coating system may include a gravure roll, and a masking plate configured to prevent the edge of a substrate from contacting the gravure roll, the masking plate including a top portion having a Rockwell B hardness equal to or greater than 80, and a thickness of between 0.03125 inches and 0.375 inches. The gravure system may have a substrate wrap angle on the gravure roll of between 1 and 30 degrees.

An embodiment of a method of gravure coating a substrate may include moving a substrate film over a surface of a rotating gravure roll and a surface of a masking plate to apply a coating to a portion of a surface of the substrate film, wherein the masking plate is configured to prevent an edge of the substrate from contacting the gravure roll, and the masking plate includes a top portion having a Rockwell B hardness equal to or greater than 80, and a thickness of between 0.03125 inches and 0.375 inches. The substrate may be moved over the surface of the rotating gravure roll in the same direction as the rotation of the gravure roll or in the opposite direction as the rotation of the gravure roll.

BRIEF DESCRIPTION OF THE DRAWINGS

The novel features which are characteristic of the present invention are set forth in the appended claims and examples. However, the invention's preferred embodiments, together with further objects and attendant advantages, will be best understood by reference to the following detailed description and Examples taken in connection with the accompanying figures in which:

FIG. 1 shows a general configuration of direct kiss coating method where the film is wrapped around the gravure roll, and the gravure roll rotates concurrent with the film direction.

FIG. 2 shows a general configuration of reverse kiss coating method where the film is wrapped around the gravure roll, and the gravure roll rotates opposite the film direction.

FIG. 3 shows the top view of a masking system, in accordance with an embodiment.

FIG. 4 shows the side view of a masking system, in accordance with an embodiment.

FIG. 5 shows the end view of a masking system, in accordance with an embodiment.

FIG. 6 shows a two-layer masking plate, in accordance with an embodiment.

FIG. 7A illustrates Comparative Example 1 using TEFLON® masking film before production.

FIG. 7B illustrates Comparative Example 1 using TEFLON® masking film after production run time.

FIG. 8 illustrates Example 1 using the dual masking plate system of stainless steel and DELRIN® (polyoxymethylene) sheet, in accordance with an embodiment.

FIG. 9 illustrates Example 1 shows ACME nut and lead screws for side-to-side (or transverse) adjustment for optimizing position of the masking plate to the substrate edge, in accordance with an embodiment.

DETAILED DESCRIPTION OF THE INVENTION

Described is a gravure coating processes in which a substrate is run in a kiss-coating configuration. The substrate can then be stretched uni-axially or bi-axially. Substrates can be any continuous polymeric material, for example, polypropylene film, polyethylene terephthalate film, polylactic acid film, etc. The process is specifically advantageous when the edges of the substrate material are much thicker than the remainder of the film. The process includes coating a substrate using a gravure roll process stationed prior to the tentering oven used for transverse orientation.

The masking system illustrated in FIGS. 3-6, utilizes a two part plate 1, with a metal top portion and a durable plastic underneath, mounted to an adjustable axis 3. The metal plate can be a variety of materials, both metal and non-metal, provided the hardness and wear resistance is sufficient. The durable plastic underneath is preferably made from a different softer material than the metal plate. The metal plate is shaped to the curvature of the gravure roll 2. Adjustable axis 3 can be several devices, for example, an ACME lead screw. In this configuration, the plate can be mounted using an ACME nut 7. Position adjustment can be accomplished using knobs 4 linked by a chain and sprockets 5, so as to not bind the adjustment and to ensure the plate remains in parallel. This "adjustable system" allows side-to-side or transverse positioning of the masking plates to effectively and easily cover the film edges if film width variations occur, without having to stop or shut-down the film-making process. Without such an adjustable system, the line would have to be shut-down and the masking plates remounted in a new position. Such a method consumes valuable production time. Locking handles 6 may also be installed to prevent movement after final adjustments are made. The flexible polymer substrate 8, which is being coated by the gravure roll 2, is shown overlaid on the masking plate 1 to illustrate how the edge of the substrate film is in contact with the masking plate.

FIG. 3 shows the top view of the masking system. The masking plate orientation in relation to the gravure roll can be seen, as well as other major mounting and adjustment components as described previously. FIG. 4 shows the side view of the masking system. Here the ACME mounting nut 7 can be clearly seen, as well as the relative elevation in relation to the gravure roll 2. FIG. 5 shows the end view of the masking system. Here the overall bent design of the masking plate 1 can be seen. This bend is matched to the gravure roll curvature 2 within the intended wrap area. FIG. 6 shows the two-layer masking plate 1 including the stainless steel plate 11 and the polymeric under-layer 12 which is in contact with the gravure roll 2.

Initial plate design was a single ⅛ inch (3.175 mm) ultra-high molecular weight polyethylene (UHMWPE), sheet manufactured as described. While superior to the commercial TEFLON® system, nevertheless, within a production run time of about 24 hours, failure due to wear was detected.

It was determined that material with Rockwell B hardness of equal to or greater than 80 was preferred. Due to the aqueous coating, use of a 1/16 inch (1.5875 mm) 304 stainless steel shield was constructed and molded to the particular gravure roll circumference for the wrap angle of the film. A 1/16 inch (1.5875 mm) DELRIN® (polyoxymethylene) sheet was mounted directly below the stainless plate, and extended 1/16 inch (1.5875 mm) past the stainless steel plate dimensions such that the DELRIN® plate was slightly larger than the stainless steel plate. This protective plastic plate protected the delicate gravure roll surface, from the metal plate.

It was surprisingly found that this two-plate system where the under-plate extends past the metal plate performed substantially better than the single plate version. Without being bound to any particular theory, it is believed that this multi-layer plate design allows for a more gradual peel of the substrate off the gravure roll and allows for a thin meniscus of coating to follow a portion of the film that is peeled. This in turn leads to a very slightly thinner coating for a short portion of the substrate (less than 3 mm). Thus there is a gradual transition in the coating thickness on the film substrate between being fully coated, to partially coated, to the non-coated film substrate edge. This system allows for in-line coated film material to be more stably produced as compared to other masking systems, as lines of uneven stretching can be eliminated.

EXAMPLES

This invention will be better understood with reference to the following examples, which are intended to illustrate specific embodiments within the overall scope of the invention.

Comparative Example 1

An in-line coated biaxially oriented polypropylene (BOPP) film was produced using an in-line gravure coating method. The edge of the film had a thickness of 850 gauge (8.5 mil or 212.5 μm) and the center of the film had a thickness of 675 gauge (6.75 mil or 168.75 μm). A reverse kiss-coat gravure process was used to apply about 12 microns of wet thickness of an aqueous solution of a nominal 14% non-volatile solids (NVS) coating. The thick edge area was 40 mm wide while a commercial TEFLON® film was used to mask a 65 mm of the film edge. No stable production greater than 16 minutes could be achieved or maintained due to film instabilities leading to film breaks.

FIGS. 7A and 7B illustrate Comparative Example 1 using TEFLON® masking film before and after production run time wherein the latter exhibited significant and unacceptable wear.

Comparative Example 2

An in-line coated BOPP film was produced. The edge of the film was 850 gauge (8.5 mil or 212.5 μm) and the center of the film was 675 gauge (6.75 mil or 168.75 μm). A reverse kiss-coat gravure process was used to apply about 12 microns of wet thickness of an aqueous solution of a nominal 14% non-volatile solids (NVS) coating. The thick edge was 40 mm wide while a commercial TEFLON® film was used to mask 43 mm of the film edge. Due to severe abrasion from the thick edge, the TEFLON® film required indexing of about 1 inch (2.54 cm) every 30 minutes in order to have a fresh unabraded section of the masking film in contact with the substrate edge for effective prevention of coating the edge. Due to these limitations within the system, the total run time for film production was limited to about 30 hours of run time before the TEFLON® film ran out. To continue production, a minimum of 1 hour of downtime was necessary to install additional TEFLON® masking film. Moreover, for this production campaign, non-coated stretch lines were seen after transverse stretching that caused some stability issues during subsequent trimming of the coated and oriented film.

Comparative Example 4

An in-line coated biaxially oriented polyester terephthalate (BOPET) film was produced. The edge of the film had a thickness of 115 gauge (1.15 mil or 28.75 μm) and the center of the film had a thickness of 90 gauge (0.9 mil or 22.5 μm). A reverse kiss-coat gravure process was used to apply about 5.3 microns of wet thickness of an aqueous solution of nominal 14% NVS. The thick edge area was 38 mm wide while a commercial TEFLON® film was used to mask 75 mm of the film edge. Due to severe abrasion from the thick edge, the TEFLON® masking film required indexing of about 1 in (2.54 cm) every 60 minutes in order to have a fresh unabraded section of masking film in contact with the substrate edge. Due to these limitations within the system, the total production run time was limited to about 72 hrs of run time before the Teflon® masking film ran out. To continue production, a minimum of 1 hour of downtime was necessary to install additional masking film.

Comparative Example 5

An in-line coated BOPP film was produced. The edge of the film was 850 gauge (8.5 mil or 212.5 μm) and the center of the film was 675 gauge (6.75 mil or 168.75 μm). A reverse kiss-coat gravure process was used to apply about 12 microns of wet thickness of an aqueous solution of nominal 14% NVS. The thick edge area was 40 mm wide while a ⅛ inch (3.175 mm) thick UHMWPE (ultra high molecular weight polyethylene) masking plate was mounted as described within the description. The masking plate provided 45 mm of uncoated area on the edge. This design showed no issues with abrasion until about 20 hours into production when some signs of wear were seen. At about 24 hours of production, the film-making line was stopped as the plate had become too worn. Additionally for this production campaign, non-coated stretch lines were seen after transverse stretching that caused some minimal stability issues during subsequent trimming.

Example 1

An in-line coated BOPP film was produced. The edge of the film was 1100 gauge (11 mil or 275 μm) thick and the center of the film was 875 gauge (8.75 mil or 218.75 μm) thick. A reverse kiss-coat gravure process was used to apply about 12 microns of wet thickness of an aqueous solution of nominal 14% NVS. The thick edge was 40 mm wide while a 1/16 inch (1.5875 mm) thick 304 stainless steel plate with a 1/16 inch 1.5875 mm) thick DELRIN® underplate was mounted as described within the description. The DELRIN® plate extended 1/16 inch (1.5875 mm) beyond the stainless plate. This method initially provided 51 mm of uncoated area, and was initially unstable within the process, with a breakage of the product within 7 minutes. After manually adjusting, using the adjustable ACME nut and lead screw design, the masking to 43 mm of uncoated area, the process became stable with no further disruptions for the remainder of the campaign. After 24 hours run time, very little wear was observed from the abrasive force of the thick substrate edges. For this production campaign, there were no issues or problems with the non-coated stretch lines detailed in Comparative Example 1.

FIG. 8 illustrates Example 1 using the dual masking plate system of stainless steel and DELRIN® under-layer after significant production run time, showing no to very little wear. FIG. 9 illustrates Example 1 showing the ACME nut and lead screws for side-to-side (or transverse) adjustment for optimizing position of the masking plate to the substrate edge.

Example 2

An in-line coated BOPET film was produced. The edge of the film was 115 gauge (1.15 mil or 28.75 μm) thick and the center of the film was 90 gauge (0.9 mil or 22.5 μm) thick. A reverse kiss-coat gravure process was used to apply about 5.3 microns wet thickness of an aqueous solution of nominal 14% NVS. The thick edge was 38 mm wide while a 1/16 inch (1.5875 mm) thick 304 stainless steel plate with a 1/16 inch (1.5875 mm) thick PFTE filled DELRIN® underplate was mounted as described within the description. For this application, the PFTE filled DELRIN® underplate was procured for lower friction (COF or coefficient of friction) and enhanced wear resistance. The DELRIN® plate extended 2 inches beyond the stainless plate, to ensure that no coating was included within the trim for further recycling processes. A total of 90 mm was left uncoated on the film edges with this design. For this design minimal maintenance of cleaning the masking every 12 hours was required as to remove small particles. Due to the plate design a quick cleanup could be coordinated with cutovers such that there was no lost product or downtime. With a typical run of 21 days, this provided over 3 hrs of downtime improvement, a significant improvement over the Comparative Examples.

The above description is presented to enable a person skilled in the art to make and use the invention, and is provided in the context of a particular application and its requirements. Various modifications to the preferred embodiments will be readily apparent to those skilled in the art, and the generic principles defined herein may be applied to other embodiments and applications without departing from the spirit and scope of the invention. Thus, this invention is not intended to be limited to the embodiments shown, but is to be accorded the widest scope consistent with the principles and features disclosed herein. Finally, the entire disclosure of the patents and publications referred in this application are hereby incorporated herein by reference.

The invention claimed is:

1. A masking system to prohibit coating transfer to substrate edges during a gravure coating process comprising:

a substrate;

a gravure roll; and a masking plate comprising a top portion plate and a bottom polymeric plate, the top plate having a Rockwell B hardness equal to or greater than 80, and a thickness of between 0.03125 inches and 0.375 inches, wherein a first side of the bottom polymeric plate is in contact with a first side of the top plate, a second side of the top plate opposite the bottom polymeric plate is in contact with an edge portion of the substrate, and a second side of the bottom polymeric plate opposite the top plate is in contact with the gravure roll, the substrate is overlaid on the masking plate with the edge portion of the substrate contacting the masking plate, the masking plate is mounted on an adjustable axis so that the masking plate lies parallel and is located between the edge portion of the substrate and the gravure roll, thereby preventing the edge portion of the substrate from contacting the gravure roll.

2. The masking system of claim 1, wherein the top plate is metal.

3. The masking system of claim 1, wherein the top plate is stainless steel.

4. The masking system of claim 1, wherein the masking plate further comprises a polymeric material coated or contiguously attached to the top plate, the polymeric material having a thickness of between 0.01 and 0.375 inches and a coefficient of friction (COF) of less than 0.40.

5. The masking system of claim 1, wherein the bottom polymeric plate has a thickness of between 0.03125 inches and 0.375 inches and a coefficient of friction (COF) of less than 0.40.

6. The masking system of claim 1, wherein the bottom polymeric plate has dimensions that extend beyond dimensions of the top plate by between 0.001 and 3.0 inches.

7. The masking system of claim 1, wherein the bottom polymeric plate is formed from a material that is less hard than the top plate.

8. The masking system of claim 1, wherein the masking plate is adjustable within 0.5 mm along a transverse direction of a face of the gravure roll.

9. The masking system of claim 1, wherein the masking plate is shaped to a curvature of the gravure roll.

* * * * *